343-700 MS AU 254 EX
10/18/83 OR 4,410,891

United States Patent [19]

Schaubert et al.

[11] 4,410,891

[45] Oct. 18, 1983

[54] MICROSTRIP ANTENNA WITH POLARIZATION DIVERSITY

[75] Inventors: Daniel H. Schaubert; Frederick G. Farrar, both of Silver Spring, Md.

[73] Assignee: The United States of America as represented by the Secretary of the Army, Washington, D.C.

[21] Appl. No.: 292,101

[22] Filed: Aug. 11, 1981

Related U.S. Application Data

[63] Continuation of Ser. No. 103,798, Dec. 14, 1979, abandoned.

[51] Int. Cl.[3] ..... H01Q 1/38
[52] U.S. Cl. ..... 343/700 MS
[58] Field of Search ..... 343/700 MS, 854, 769, 343/846, 701, 829, 830

[56] References Cited

U.S. PATENT DOCUMENTS

| | | | |
|---|---|---|---|
| 3,921,177 | 11/1975 | Munson | 343/700 MS |
| 4,035,807 | 7/1977 | Tang et al. | 343/700 MS |
| 4,053,895 | 10/1977 | Malagisi | 343/700 MS |
| 4,191,959 | 3/1980 | Kerr | 343/700 MX |

*Primary Examiner*—Eli Lieberman
*Attorney, Agent, or Firm*—Robert P. Gibson; Anthony T. Lane; Saul Elbaum

[57] ABSTRACT

This invention comprises sn inexpensive, flush-mounted microstrip antenna the polarization of which is easily changed from vertical linear to horizontal linear, left-circular, right-circular or any desired elliptical sense. This enables the designer to select the polarization by selecting the proper location of shorting posts in the antenna. The use of rf switching diodes in place of conventional shorting posts provides a means of electronically switching the polarization.

10 Claims, 17 Drawing Figures

SECTION CC

SECTION DD

MICROSTRIP ANTENNA WITH POLARIZATION DIVERSITY

RIGHTS OF THE GOVERNMENT

The invention described herein may be manufactured, used or licensed by or for the government of the United States of America for governmental purposes without payment to us of any royalties therefor.

This application is a continuation of application Ser. No. 103,798, filed Dec. 14, 1979, now abandoned.

BACKGROUND OF THE INVENTION

In the antenna art it is often highly desirable, especially when dealing with projectiles, missiles, and aircraft, to be able to construct antenna means which exhibit a selectable radiation polarization while having a low profile for aerodynamic reasons. Various types of antenna devices are known in the prior art which exhibit a desirable aerodynamic profile. However, since most conventional antennas are inherently either linearly or circularly polarized, it is necessary to have at least two antennas and associated power dividers, phase shifters, and rf switches to provide complete polarization coverage. It would be highly desirable to construct a single antenna element which could provide complete polarization coverage without the necessity of using power dividers, phase shifters, etc.

It is therefore an object of this invention to provide a microstrip antenna element which is capable of providing selectable radiation polarization.

It is also an object of this invention to provide an antenna element which will provide polarization coverage without the necessity of multiple antennas or associated complex circuitry. It is a further object of the invention to provide an antenna element which may be selectively polarized in any one of several polarization senses by simple electronic switching.

It is yet another object of the invention to provide such an antenna having a low profile and desirable aerodynamic qualities.

SUMMARY OF THE INVENTION

This disclosure describes a microstrip antenna with the unique property that its polarization can be altered by changing the position of shorting posts in the antenna. Linear polarization, either vertical or horizontal, or left or right circular polarization, or any desired elliptical polarization sense can be obtained from a single microstrip patch radiator with no dimensional changes in the antenna.

The present antenna is one of a family of new microstrip antennas that uses a very thin laminated structure which can readily be mounted on flat or curved irregular structures, presenting low physical profile where minimum aerodynamic drag is required. The electric microstrip antenna consists essentially of a conducting strip called the radiating element and a conducting ground plane separated by a dielectric substrate. The length of the radiating element is approximately one-half wavelength. The conducting ground plane is usually much greater in length and width than the radiating element. The antenna element, or conducting patch, may be etched on one side of the dielectric substrate using standard printed circuit techniques.

DETAILED DESCRIPTION OF THE INVENTION

Figure 1A:
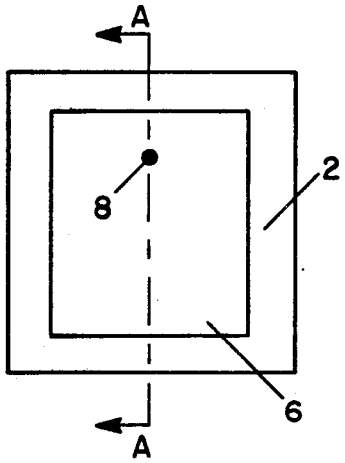
FIGS. 1A and 1B illustrate a typical microstrip patch radiator as known in the prior art.
Figure 1B:
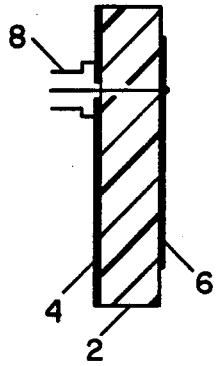
FIG. 1B PRIOR ART

FIGS. 1A and 1B illustrate a conventional microstrip patch radiator as is known in the prior art. Standard printed circuit techniques are used to etch a conducting patch 6 on one side of a teflon-fiberglass or other low loss dielectric substrate 2. The size of the conducting patch and the relative dielectric constant of the substrate material determine the operating frequency of the antenna. For a square patch, the length of a side is approximately equal to one-half of a wavelength in the dielectric. The conducting sheet 4 is formed on the reverse side of the substrate to form a ground plane. The rf input may be by means of a standard co-axial connector 8. FIG. 1B is sectional view along line AA of FIG. 1A, and shows the manner in which the co-axial input is connected to the ground plane and conductive patch.

Figure 2A:
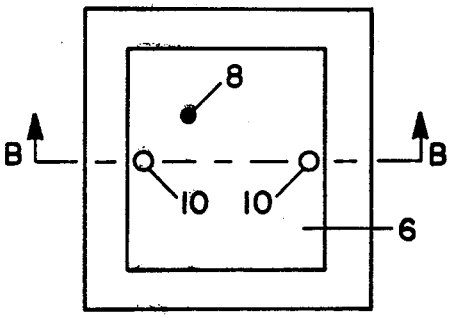
FIGS. 2A and 2B illustrate a vertically polarized microstrip antenna utilizing conventional shorting posts.
Figure 2B:
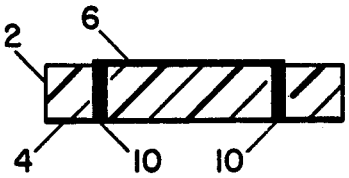
Figure 3:
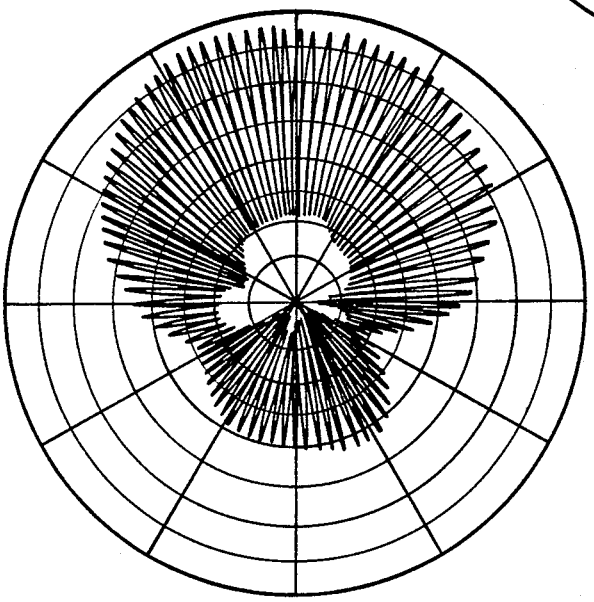
FIG. 3 illustrates the radiation pattern of a typical linearly polarized antenna element.
Figure 11:
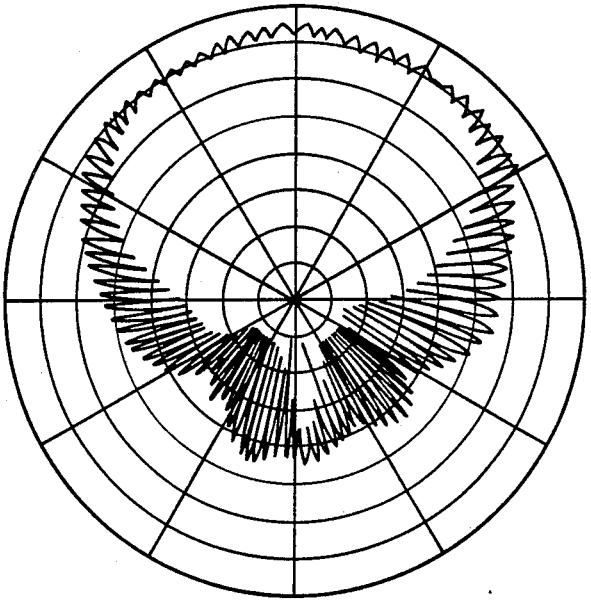
FIG. 11 is a graphical illustration of a typical radiation pattern for a circularly polarized antenna element.

To construct a patch radiator which is polarized linearly in a vertical direction one could provide shorting posts 10, as shown in FIG. 2A. In the device of FIG. 2A, input 8 may be located along the diagonal of the conducting patch 6. FIG. 2B is a sectional view along line BB of FIG. 2A, and illustrates how the conventional shorting posts 10 extend between the conducting patch 6 and the ground plane 4. The posts consist of an electrically conductive material such as a bolt or rivet or some similar means. FIG. 3 shows a typical radiation pattern of such a vertically polarized microstrip antenna.

FIGS. 4A–4D illustrate typical embodiments of the present inventive concept. The microstrip antenna of the present invention comprises a substrate 2, conductive patch 6, and ground plane 4 as previously described. In place of the conventional shorting posts 10, switching diodes are connected between the conductive patch and the ground plane. Application of a DC bias voltage to the diodes will selectively complete an electrical path through particular ones of the diodes between the conductive patch and the ground plane.

Figure 4A:
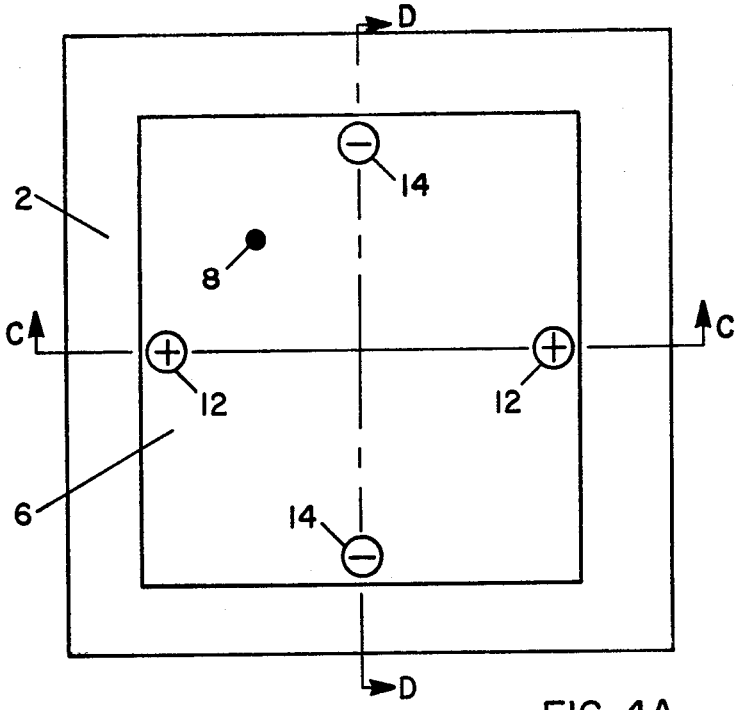
FIGS. 4A–4D illustrate an embodiment of the invention which may be linearly polarized in a vertical or horizontal direction.
Figure 4B:
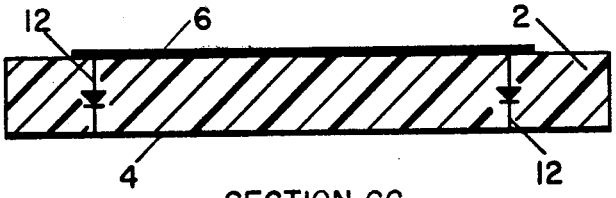

More particularly, FIG. 4A illustrates a microstrip antenna having co-axial input 8 located along the diagonal of the patch 6. Positively biased switching diodes 12, are located along the horizontal axis of symmetry of the patch, while negatively biased switching diodes 14 are located along the vertical axis of symmetry. FIG. 4B is a sectional view along line CC of FIG. 4A. As can be seen, a positive DC voltage applied to the patch 6 will complete a circuit through the positively biased switching diodes 12. FIG. 4C is a sectional view along line DD of FIG. 4A and illustrates how a negative bias DC voltage applied to the patch 6 will complete a circuit through the negatively biased switching diodes 14. The DC bias voltage may be applied across the rf input 8 through a standard bias tee. When a positively biased voltage is applied to the patch 6, the electrical path completed through the positively biased diodes 12 will cause these diodes to act as shorting posts between the patch 6 and ground plane 4. This will cause the antenna to radiate in a linearly polarized fashion in a vertical direction, in the manner of the device of FIGS. 2A and 2B. If a negative bias voltage is applied to the patch 6, the path completed through switching diodes 14 will cause these diodes to act as shorting posts, resulting in a horizontally linearly polarized antenna. Therefore, by applying a DC voltage of a given bias the antenna may be alternately linearly polarized in a horizontal or vertical direction.

Figure 4D:
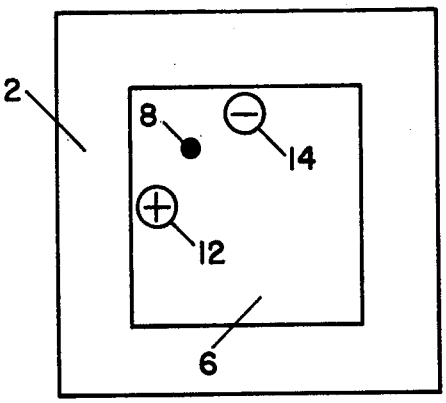
Figure 4C:
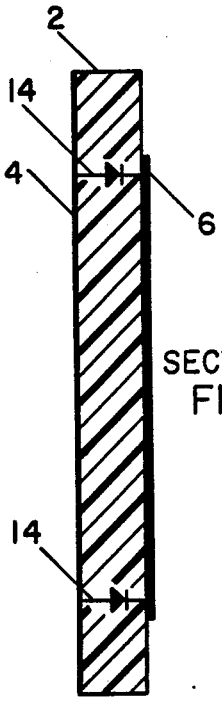

FIG. 4D illustrates an embodiment of the invention similar to that of FIG. 4A. However, instead of a pair of positively biased switching diodes and a pair of negatively biased diodes, a single diode of each bias is provided between the patch 6 and the ground plane 4. As is shown in FIG. 4D, input 8 remains located along the diagonal of patch 6. A positively biased rf switching diode 12 and a negatively biased rf switching diode 14 are located approximately midway along adjacent sides of the patch 6. By means of selective application of a positive or negative DC bias voltage to the patch 6 an electrical path will be completed through either diode 12 or diode 14 in the manner described above. Experimental results have shown that a single diode 12 or 14 is sufficient to cause the patch radiator to radiate in a linear fashion in the vertical or horizontal direction.

Figure 5:
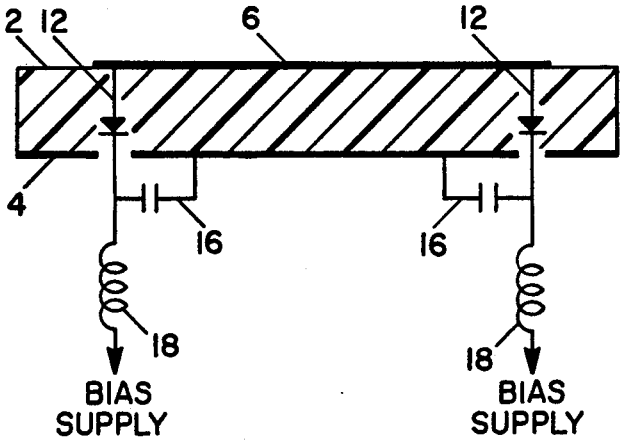
FIG. 5 illustrates an external control circuit for the device of the present invention.

The bias voltage signal need not be supplied through the rf input 8, as described above, but may be supplied through an external bias network as shown in FIG. 5. The network consists of an rf bypass capacitor 16 and an rf choke 18, as shown. The choke acts as a low-pass filter allowing the DC bias voltage in from the bias supply while preventing a loss of the rf signal. By the use of proper switching and circuitry the external bias supply may be arranged such that any single diode or any set of diodes may be selectively actuated by the bias voltage in order to change the polarization sense of the antenna. Also, if a high-power rf signal is applied to the patch, it may be necessary to reverse bias the open circuit diodes to ensure that they are not biased on by the rf signal. This can be accomplished by use of the external bias network.

Figure 6A:
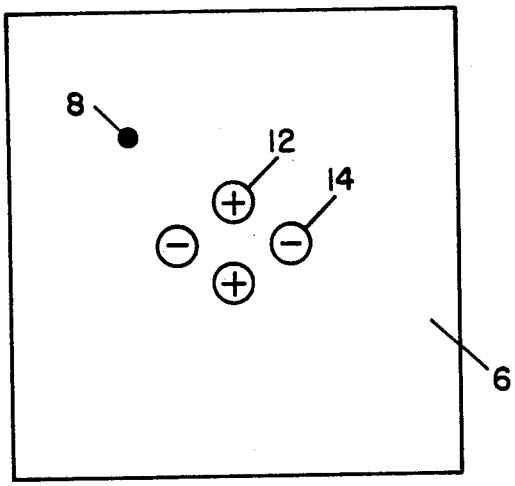
FIGS. 6A and 6B illustrate embodiments of the invention which may exhibit right or left circular polarization.
Figure 6B:
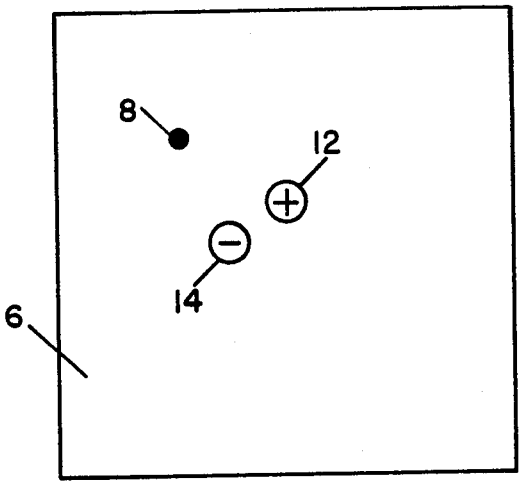

FIGS. 6A and 6B illustrate embodiments of the invention which may be used to create a left or right circularly polarized microstrip antenna. Reference numeral 6 indicates the conductive patch as previously described. Positively biased switching diodes 12 and negatively biased switching diodes 14 are connected between the patch 6 and the ground plane 4 (not shown). When an electrical circuit is completed through the positively biased diodes 12, in the manner described above, a right circularly polarized radiation pattern results. Likewise, when an electrical circuit is completed through negatively biased diodes 14, a left circularly polarized radiation pattern is the result. FIG. 6B illustrates an embodiment which utilizes a single positively biased diode 12 and a single negatively biased diode 14. Experimental results indicate that this embodiment will achieve the same result as the embodiment of FIG. 6A.

Figure 7:
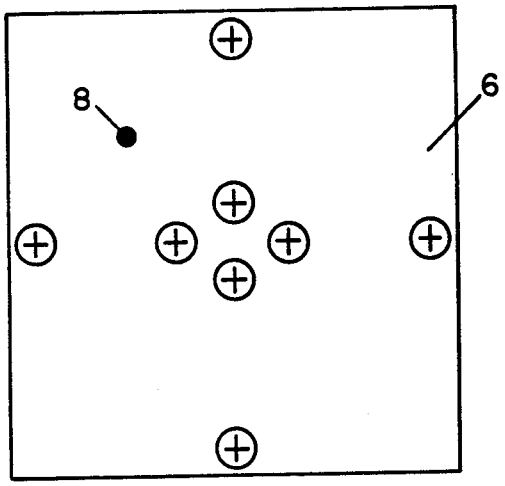
FIG. 7 illustrates an embodiment of the invention which may exhibit left or right circular polarization or horizontal or vertical linear polarization.

FIG. 7 illustrates a mode of construction of the device of the present invention which combines the features of the embodiments of FIGS. 4A and 6A. The embodiment comprises a biased switching diode midway along each side of the square patch, as well as the diodes proximate the center of the patch. Through selective actuation of the proper diode or diodes the microstrip patch antenna of FIG. 7 can be made to radiate in a vertical or horizontal linear polarization or a left or right circular polarization. If the DC bias voltage is applied through the rf input, the antenna will only be capable of discriminating between two radiation patterns. Since the device of FIG. 7 is capable of radiating in at least four patterns, the DC bias voltage signal must be provided through an external biasing circuit, as shown in FIG. 5. The circuit would be designed to selectively apply a DC voltage signal to any one or any selected set of diodes in order to provide the proper pattern of shorting posts in the antenna element. Since the DC voltage signal is applied in this manner, all of the diodes may be oriented in the same direction as can be seen in FIG. 7. FIG. 7 illustrates all of the diodes as being positively oriented, but it is to be understood that they may all be negatively oriented, or some may be positively oriented while others are negatively oriented.

Figure 8:
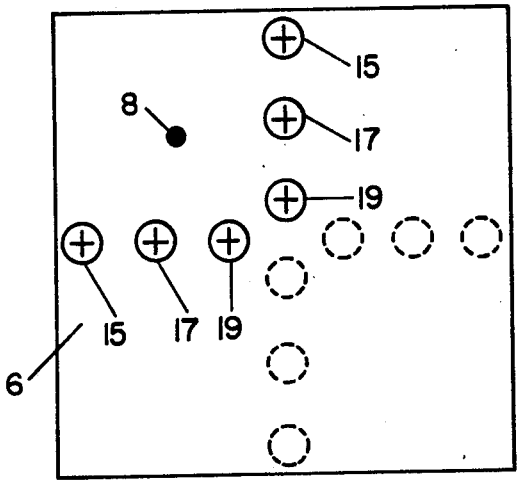
FIG. 8 illustrates an embodiment of the invention having the capabilities of the embodiment of FIG. 7, with the additional capability of elliptical polarization.

FIG. 8 shows an embodiment of the invention which is capable of generating an elliptical polarization pattern. As discussed with reference to the preceeding embodiments, either of diodes 15 may be biased on to generate a vertical or horizontal linear radiation pattern while either of diodes 19 may be biased on to generate a left or right circular polarized radiation pattern. Diodes 17 are located along the axes of symmetry of the patch at positions intermediate the locations of diodes 15 and 19 respectively. If one of the diodes 17 is biased on by the external biasing circuit the patch antenna will exhibit an elliptically polarized radiation pattern. Varying the position of the diode 17 along the line extending between diodes 15 and 19 will vary the ellipticity ratio of the radiation pattern. The dotted circle positions shown in FIG. 8 indicate that any one of the radiation modes may be realized by selective actuation of one or a pair of shorting diodes, as discussed above.

Figure 9:
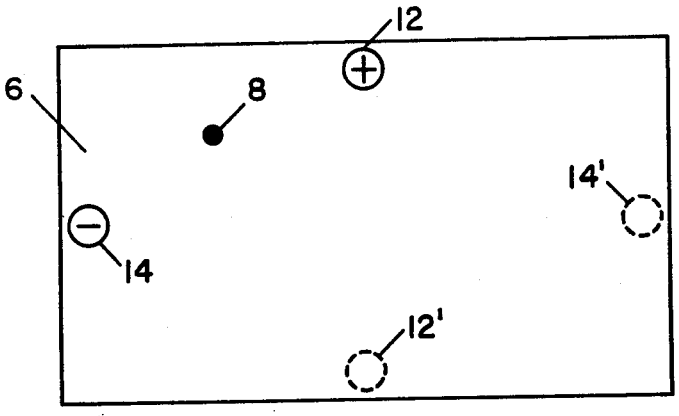
FIG. 9 illustrates an embodiment of the present invention which may radiate at multiple frequencies.

FIG. 9 illustrates an embodiment of the invention which is capable of radiating at more than one frequency. Rather than being of square shape, the patch 6 is of rectangular shape. Input 8 is located along the diagonal thereof. If the positively biased diode 12 (or the diodes 12 and 12') is actuated, the patch antenna will radiate in a horizontally linear mode at a frequency determined by the length of the longer side of the patch. Likewise, if the negatively biased diode 14 (or diodes 14 and 14') is actuated, the patch antenna will radiate in a vertically linear pattern at a frequency determined by the length of the shorter side of the rectangular patch.

Figure 10:
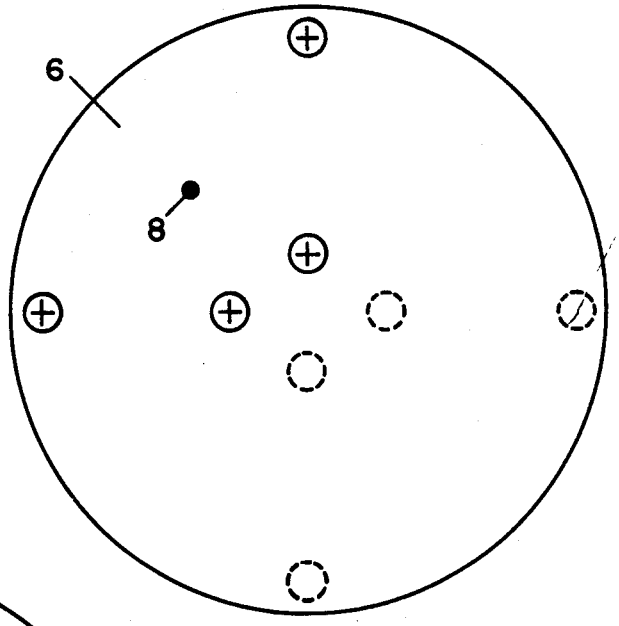
FIG. 10 illustrates a circular microstrip patch antenna embodying the principles of the present invention.

While the invention has been described with reference to square or rectangular shape patches, it is also possible to form the antenna of the present invention in other shapes which will more readily conform to the surface or configuration of a projectile or other object in which the antenna is incorporated. FIG. 10 illustrates an embodiment of the invention comprising a circular conductive patch 6. In all other respects the embodiment of FIG. 10 is similar to the previously described embodiments, although it operated at a somewhat higher frequency than a square patch with similar dimensions.

The antenna described, fed by an inductive post, is well match to 50 ohms in each polarization mode. The location of the inductive post may be adjusted to obtain input impedances other than 50 ohms. The antenna gain remains constant for each polarization. It is evident that the microstrip radiator can be formed in a variety of shapes and may be mounted conformal to the surface of a missle, rocket or projectile. The operating frequency of the device may be varied by simply varying the dimensions of the conductive patch. The device of the present invention may be manufactured cheaply using standard printed circuit etching techniques.

While the invention has been described with reference to the accompanying drawings, we do not wish to be limited to the particular details shown therein as obvious modifications may be made by those skilled in the art.

We claim:

1. A microstrip antenna capable of generating selectively polarized output comprising:

a single active element comprising a dielectric substrate, a conductive layer forming a single conductive patch on one surface of said substrate and a conductive layer forming a single conductive patch on one surface of said substrate and a conductive layer forming a ground plane on an opposed surface of said substrate;

single input means, directly coupled to said single active element, for providing a frequency input to said single active element; and means for selectively activating said single active element for generating a selectively polarized output, said polarized output being selectable from a plurality of polarizations, including left circular polarization, and right circular polarization wherein said means for selectively activating said single active element comprises multiple shorting means for providing multiple electrically conductive paths between said patch and said ground plane, and control means for selectively completing said electrically conductive paths through selected ones of said multiple shorting means.

2. A microstrip antenna as recited in claim 1, wherein a first portion of said multiple shorting means are positioned within said conductive patch whereby when said first portion is activated by said control means said polarized output is linear vertically polarized.

3. A microstrip antenna as recited in claim 2, wherein a second portion of said multiple shorting means are positioned within said conductive patch whereby when said second portion is activated by said control means said polarized output is linear horizontally polarized.

4. A microstrip antenna as recited in claim 3, wherein a third portion of said multiple shorting means are positioned within said conductive patch whereby when said third portion is activated by said control means said polarized output is left circularly polarized.

5. A microstrip antenna as recited in claim 4, wherein a fourth portion of said multiple shorting means are positioned within said conductive patch whereby when said fourth portion is activated by said control means said polarized output is right circularly polarized.

6. A microstrip antenna as recited in claim 5, wherein a fifth portion of said multiple shorting means are positioned within said conductive patch whereby when said fifth portion is activated by said control means said polarized output is elliptically polarized.

7. A microstrip antenna as recited in claim 6, wherein said multiple shorting means each comprise a switching diode.

8. A microstrip antenna as recited in claim 5 wherein:

the first and second portions of said multiple shorting means are located along the periphery of said patch; and the third and fourth portions of said multiple shorting means are located proximate the center of said patch.

9. A microstrip antenna capable of selectively generating a polarized output signal including linear vertical, linear horizontal, left circular, right circular and elliptical, comprising:

a single active element comprising a dielectric substrate, a conductive layer forming a single conductive patch on one surface of said substrate and a conductive layer forming a ground plane on an opposed surface of said substrate;

a single input means, directly coupled to said single active element, for providing an input signal to said single active element;

multiple shorting means, selectively positioned within said conductive patch, for providing multiple electrically conductive paths between said patch and said ground plane; and control means for selectively activating a first, second, third, fourth or fifth portion of said multiple shorting means, whereby activating said first portion causes said antenna to output said input signal as a linear vertical polarized signal, whereby activating said second portion causes said antenna to output said input signal as a linear horizontal polarized signal, whereby activating said third portion causes said antenna to output said input signal as a left circular polarized signal, whereby activating said fourth portion causes said antenna to output said input signal as a right circular polarized signal, whereby activating said fifth portion causes said antenna to output said input signal as an elliptical polarized signal.

10. A microstrip antenna as recited in claim 9 wherein said shorting means each comprises a switching diode.

* * * * *